US006328108B1

(12) United States Patent
Vanderford et al.

(10) Patent No.: US 6,328,108 B1
(45) Date of Patent: Dec. 11, 2001

(54) ADJUSTABLE SUB-TENSION HANGER

(75) Inventors: Delbert E. Vanderford, Cypress; Dennis P. Nguyen, Houston, both of TX (US)

(73) Assignee: Cooper Cameron Corporation

( * ) Notice: Subject to any disclaimer, the term of this patent is extended or adjusted under 35 U.S.C. 154(b) by 0 days.

(21) Appl. No.: 09/438,074

(22) Filed: Nov. 10, 1999

(51) Int. Cl.[7] ..... E21B 33/043

(52) U.S. Cl. ..... 166/348; 166/368; 285/302

(58) Field of Search ..... 166/343, 348, 166/360, 368, 208; 285/302, 145.1, 145.4, 298

(56) References Cited

U.S. PATENT DOCUMENTS

| | | | | |
|---|---|---|---|---|
| 3,861,463 | * | 1/1975 | Crowe | 166/338 |
| 4,239,083 | | 12/1980 | Silberman et al. | 166/117.7 |
| 4,408,783 | | 10/1983 | Gruller | 285/3 |
| 4,465,134 | | 8/1984 | Watkins | 166/245 |
| 4,634,152 | | 1/1987 | Pettit | 285/39 |
| 4,653,589 | | 3/1987 | Alandy | 166/382 |
| 4,653,778 | | 3/1987 | Alandy | 285/18 |
| 4,674,576 | | 6/1987 | Goris et al. | 166/382 |
| 4,714,111 | | 12/1987 | Brammer | 166/182 |
| 4,719,971 | | 1/1988 | Owens | 166/191 |
| 4,726,425 | | 2/1988 | Smith, Jr. | 166/387 |
| 4,757,860 | | 7/1988 | Reimert | 166/208 |
| 4,794,988 | | 1/1989 | van Bilderbeek | 166/345 |
| 4,823,871 | | 4/1989 | McEver et al. | 166/182 |
| 4,836,288 | | 6/1989 | Wester | 166/348 |
| 4,938,289 | | 7/1990 | van Bilderbeek | 166/342 |
| 4,995,464 | | 2/1991 | Watkins et al. | 166/382 |
| 5,176,218 | | 1/1993 | Singer et al. | 166/206 |
| 5,439,061 | | 8/1995 | Brammer et al. | 166/368 |
| 5,450,904 | * | 9/1995 | Galle | 166/348 |
| 5,524,710 | | 6/1996 | Shinn | 166/348 |
| 5,607,019 | | 3/1997 | Kent | 166/344 |
| 5,638,903 | | 6/1997 | Kent | 166/348 |
| 5,653,289 | | 8/1997 | Hosie et al. | 166/348 |
| 5,839,512 | * | 11/1998 | Malone et al. | 166/348 |
| 5,878,816 | | 3/1999 | Lalor et al. | 166/348 |
| 6,039,120 | * | 3/2000 | Wilkins et al. | 166/368 |

* cited by examiner

*Primary Examiner*—David Bagnell
*Assistant Examiner*—John Kreck
(74) *Attorney, Agent, or Firm*—Michael P. Hartmann; Peter A. Bielinski

(57) ABSTRACT

A tensioning device is disclosed which brings two tubular segments closer together with an intermediate adjustment sleeve. The sleeve is threaded externally and may be accessed internally by a tool to rotate it. The threaded sleeve is secured to the upper tubular in a manner that permits relative rotation. Rotation of the sleeve advances it downwardly in the lower tubular, pulling down the upper tubular secured to the rotating sleeve. The upper tubular translates until a load shoulder hits a support surface in the wellhead to achieve the desired tension in the string.

11 Claims, 1 Drawing Sheet

ADJUSTABLE SUB-TENSION HANGER

FIELD OF THE INVENTION.

The field of this invention relates to devices to tie a casing string back from a mudline hanger anchored at the ocean floor to a wellhead mounted on a platform at the surface.

BACKGROUND OF THE INVENTION.

The distance between a mudline hanger and a seat in the wellhead on which the hanger, at the upper end of the string, is to be landed is fixed. It is necessary to adjust the effective vertical spacing between the hangers at opposite ends of the string in some way in order to suspend it in tension. Various solutions have been proposed to this problem in the past. One is the use of short lengths of "pup" joints in the casing and another solution has been to cut the casing string at the wellhead and suspend the cut end from split-type hangers as is frequently done in the case of land-type completions. Such techniques are time consuming and costly, particularly in off-shore installations.

U.S. Pat. No. 4,794,988 discloses a hanger body which includes a vertically adjustable component. The upper portion is adapted to land on the seat in the head and the lower portion is connected to the upper end of the casing string. During installation a shoulder on the upper part is initially above and then lowered on to the seat in order to support the string and tension. This design required a hanger body of complex and expensive construction and further required the wellhead to be taller than would necessarily be required for a conventional installation. Prior solutions have not offered the use of a straight-threaded longitudinally adjustable sub in the string beneath the hanger because of frequent requirements to rotate the string in opposite directions.

U.S. Pat. No. 4,995,464 illustrates an adjustable sub which is manipulated by a tool lowered through the hanger body and into the sub so as to adjust it from an extended position in which its shoulder is above the seat in the head to a retracted position in which the shoulder is seated on the head and the casing string is placed in tension. The operation of this device is disclosed in FIGS. 2 and 3 of U.S. Pat. No. 4,995,464. A sleeve 23 disposed between tubular members 21 and 22. The tubular members 21 and 22 are, rotationally locked by lug 24. The sleeve 23 has opposite hand threads on an inner and an outer surface to match corresponding threads on the tubular members 21 and 22. Rotation of the sleeve 23 translates the tubular 21 and the sleeve 23 downwardly to land the shoulder on the seat in the head. The disadvantages of the design in U.S. Pat. No. 4,995,464 are that the sleeve 23 is difficult to manufacture and operate.

Also relevant in this field are U.S. Pat. Nos. 4,408,783; 4,465,134; 4,653,589; 4,653,778; 4,726,425; 4,239,083; 4,634,152; 4,674,576; 4,714,111; 4,719,971; 4,823,871; 4,836,288; 5,176,218; 5,439,061; 5,607,019; 5,638,903; 5,653,289; 4,757,860.

U.S. Pat. No. 5,524,710 illustrates the use of external grooves and a dog which is insertable into the grooves to maintain tension on the string off of a seat or support shoulder in the wellhead.

U.S. Pat. Nos. 4,938,289 and 4,794,988 illustrate the use of a lock-ring device to retain tension on the string off of a seat or support in the wellhead after tension is pulled on the string.

Finally, U.S. Pat. No. 5,878,816 shows the same technique as illustrated in U.S. Pat. No. 5,524,710 of putting dogs in grooves to retain tension held on the string so that the string is supported off a support surface in the wellhead for retaining the tension.

SUMMARY OF THE INVENTION.

A tensioning device is disclosed which brings two tubular segments closer together with an intermediate adjustment sleeve. The sleeve is threaded externally and may be accessed internally by a tool to rotate it. The threaded sleeve is secured to the upper tubular in a manner that permits relative rotation. Rotation of the sleeve advances it downwardly in the lower tubular, pulling down the upper tubular secured to the rotating sleeve. The upper tubular translates until a load shoulder hits a support surface in the wellhead to achieve the desired tension in the string.

Figure 1:
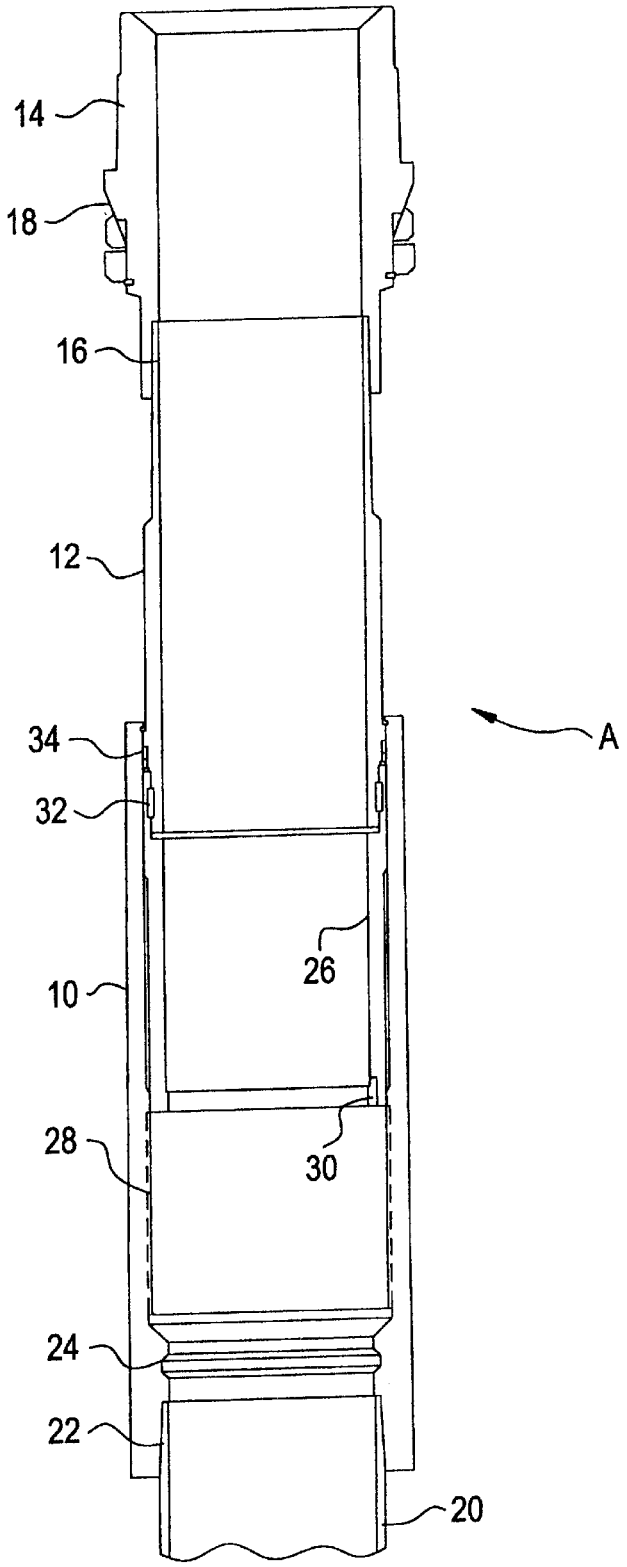
FIG. 1 is a sectional elevational view of the adjustable sub-tension hanger of the present invention.

DETAILED DESCRIPTION OF THE PREFERRED EMBODIMENT.

Referring to FIG. 1, those skilled in the art will appreciate that the wellhead has been omitted for clarity and the adjustment device is the only thing depicted. Referring to FIG. 1, the apparatus A includes a lower tubular 10 and an upper tubular 12. Secured to the upper tubular 12 is tension hanger 14 which is attached at thread 16. The hanger 14 has a peripheral tapered shoulder 18 which ultimately engages a mating surface in the wellhead (not shown) when the proper amount of tension has been applied to the tubular string 20 which is connected to the lower tubular 10 at thread 22. Those skilled in the art will appreciate that the tubular string 20 is secured at the ocean floor to a mudline hanger (not shown). Tension is pulled on the string 20 through a tool which engages the tension groove 24. When an upward tensile force is applied to groove 24, shoulder 18 moves further away from its mating shoulder in the wellhead (not shown). In order to close that gap and retain the tension applied to the string 20 through groove 24, an adjustment sleeve 26 is threadly engaged to lower tubular 10 via an internal thread 28 on the adjustment sleeve 26. One or more grooves 30 are disposed at the lower end of adjustment sleeve 26 to facilitate the insertion of the tool to turn it with respect to lower tubular Those skilled in the art can see that with a tensile force applied to the string 20 through tension groove 24, a tool can be inserted into grooves 30 to rotate adjustment sleeve 26. Rotation of adjustment sleeve 26 moves it downwardly toward tension groove 24. Because of the connection at segmented-ring 32, the downward movement of the adjustment sleeve 26 results in translation of the upper tubular 12 and with it the seal 34. The segmented ring connection 32 removes the need to rotationally lock the upper tubular 12. Optionally a rotational lock can be added. Eventually, sufficient rotation of adjustment sleeve 26 is accomplished to bring the tapered shoulder 18 into contact with its mating shoulder in the wellhead (not shown) in order to retain the tension which, up until that time, had been held in the string 20 by a tool inserted into tension groove 24. The tension tool is removed from groove 24 and the tool to rotate the adjustment sleeve 26 is removed from groove 30 when shoulder 18 lands on its mating shoulder in the wellhead (not shown).

Those skilled in the art can now see that this design is relatively simple and presents a more economical and reliable design than that shown in U.S. Pat. No. 4,995,464. The sleeve 26 only requires a thread on one side as opposed to an intermediate sleeve between the two tubulars with an inside and outside thread as illustrated in the prior art. The use of the intermediate sleeve effectively limits the internal diameter available through the central bore of the prior art device illustrated in the U.S. Pat. No. 4,995,464. This is distinguished from the apparatus A of the present invention where the adjustment sleeve 26 has the same internal diameter as the upper tubular 12 and even, perhaps, a greater diameter. This means that the adjustment sleeve 26 does not reduce the minimum diameter through the string 20 or at most reduces it less than a sleeve threaded inside and out.

It should be recognized that while the present invention has been described in relation to the preferred embodiment thereof, those skilled in the art may develop a wide variation of structural details without departing from the principles of the invention. Therefore, the appended claims are to be construed to cover all equivalents falling within the true scope and spirit of the invention.

What is claimed is:

1. An assembly for tensioning a tubular string for support from a wellhead support surface, comprising:

a lower tubular member for connection to the tubular string;

an upper tubular member having a shoulder for engagement with the support surface in the wellhead;

an adjustment sleeve further comprising a single thread, said single thread on said adjustment sleeve connected to only one of said upper and lower tubular members while the connection to the other of said tubular members from said adjustment sleeve allows for relative rotation and is without a thread, whereupon when said adjustment sleeve is rotated, relative movement occurs between said upper and lower tubular members.

2. The assembly of claim 1, further comprising:

a connection between said adjustment sleeve and said upper tubular which allows relative rotation as well as tandem longitudinal movement which brings said shoulder toward the support surface.

3. The assembly of claim 1, wherein:

said adjustment sleeve has an outer surface in contact with said lower tubular with said single thread disposed therebetween.

4. The assembly of claim 1, wherein:

said upper tubular and adjustment sleeve having a bore therethrough, said bore in said adjustment sleeve is at least as large as said bore in said upper tubular.

5. An assembly for tensioning a tubular string for support from a wellhead support surface, comprising:

a lower tubular member for connection to the tubular string;

an upper tubular member having a shoulder for engagement with the support surface in the wellhead;

an adjustment sleeve further comprising a single thread, said adjustment sleeve connected to said upper and lower tubular members such that when said adjustment sleeve is rotated, relative movement occurs between said upper and lower tubular members;

a connection between said adjustment sleeve and said upper tubular member which allows relative rotation as well as tandem longitudinal movement which brings said shoulder towards the support surface; and a seal between said upper tubular and said lower tubular.

6. An assembly for tensioning a tubular string for support from a wellhead support surface, comprising:

a lower tubular member for connection to the tubular string;

an upper tubular member having a shoulder for engagement with the support surface in the wellhead;

an adjustment sleeve further comprising a single thread, said adjustment sleeve connected to said upper and lower tubular members such that when said adjustment sleeve is rotated, relative movement occurs between said upper and lower tubular members;

a connection between said adjustment sleeve and said upper tubular member which comprises a dog, said adjustment sleeve and said upper tubular member comprise opposed grooves, said dog residing in said grooves.

7. The assembly of claim 6, wherein:

said dog comprises a segmented ring.

8. An assembly for tensioning a tubular string for support from a wellhead support surface, comprising:

a lower tubular member for connection to the tubular string;

an upper tubular member having a shoulder for engagement with the support surface in the wellhead;

an adjustment sleeve further comprising an outer surface in contact with said lower tubular member and further comprising a single thread disposed therebetween, said adjustment sleeve connected to said upper and lower tubular members such that when said adjustment sleeve is rotated, relative movement occurs between said upper and lower tubular members;

said upper tubular member is secured to said adjustment sleeve by a dog disposed in opposed grooves in said upper tubular member and said adjustment sleeve.

9. The assembly of claim 8, wherein:

said dog comprises a segmented ring.

10. The assembly of claim 9, wherein:

said adjustment sleeve has an internal surface and at least one recess to facilitate its rotation with a tool.

11. The assembly of claim 10, further comprising:

a seal between said upper and lower tubulars.

* * * * *